US008991618B2

(12) United States Patent
Green

(10) Patent No.: US 8,991,618 B2
(45) Date of Patent: Mar. 31, 2015

(54) METHOD OF CARTRIDGE CASE SORTING AND SORTING APPARATUS

(76) Inventor: Jeffrey Scott Green, Marlboro, NJ (US)

( * ) Notice: Subject to any disclaimer, the term of this patent is extended or adjusted under 35 U.S.C. 154(b) by 651 days.

(21) Appl. No.: 13/217,788

(22) Filed: Aug. 25, 2011

(65) Prior Publication Data

US 2012/0048785 A1 Mar. 1, 2012

Related U.S. Application Data

(60) Provisional application No. 61/402,312, filed on Aug. 27, 2010.

(51) Int. Cl.

| | |
|---|---|
| ***B07B 13/00*** | (2006.01) |
| ***B07B 13/04*** | (2006.01) |
| ***B07B 1/46*** | (2006.01) |
| ***F42B 33/10*** | (2006.01) |

(52) U.S. Cl.

CPC ..... *B07B 13/04* (2013.01); *B07B 1/469* (2013.01); *F42B 33/10* (2013.01)

USPC ..... 209/682; 209/680

(58) Field of Classification Search

CPC ..... B07B 13/04; B07B 1/469; F42B 33/10

USPC ..... 209/659, 680, 682, 684, 397, 325, 322, 209/244, 910

See application file for complete search history.

(56) References Cited

U.S. PATENT DOCUMENTS

| | | | | | |
|---|---|---|---|---|---|
| 1,189,167 | A * | 6/1916 | Parker | 209/625 |
| 2,295,190 | A * | 9/1942 | Zenge | 209/674 |
| 4,323,160 | A * | 4/1982 | Cowgill | 209/632 |
| 5,211,291 | A * | 5/1993 | Kelley et al. | 209/680 |
| 5,819,951 | A * | 10/1998 | Sultanovich et al. | 209/313 |
| 2007/0170099 | A1 * | 7/2007 | Stolworthy | 209/44 |

OTHER PUBLICATIONS www.shellsorter.com, copyright 2007-2009, printed out on Aug. 22, 2011, "Welcome!" page, "The Shell Sorter™" pp. 1-3, "Buy the Shell Sorter™" page, "380 Shell Sorter ™ plate!" page.

* cited by examiner

*Primary Examiner* — Joseph C Rodriguez
*Assistant Examiner* — Kalyanavenkateshware Kumar
(74) *Attorney, Agent, or Firm* — Walter J. Tencza, Jr.

(57) ABSTRACT

An apparatus for sorting objects, such as firearm cartridge cases is provided. The apparatus may include a motor, such as an electrically powered motor. The apparatus may also include a tray assembly having a first plurality of slots, a box assembly, a base assembly having a bottom member, and a first bin lying beneath the first plurality of slots. The tray assembly may be fixed to the box assembly so that the tray assembly is angled with respect to a flat ground surface when the bottom member lies on the flat ground surface. The motor may be connected to the tray assembly so that when the motor is electrically powered on, the motor vibrates the tray assembly. Each of the first plurality of slots may be sized so that a first type of object will fall through each of the first plurality of slots and into the first bin.

11 Claims, 4 Drawing Sheets

Fig. 4
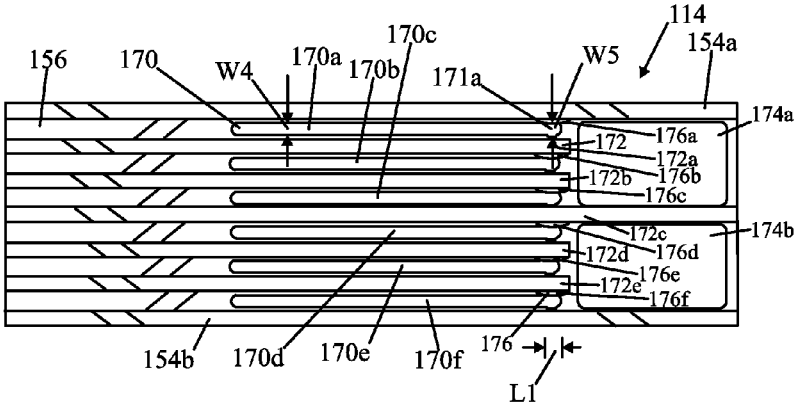
Fig. 6
Fig. 5
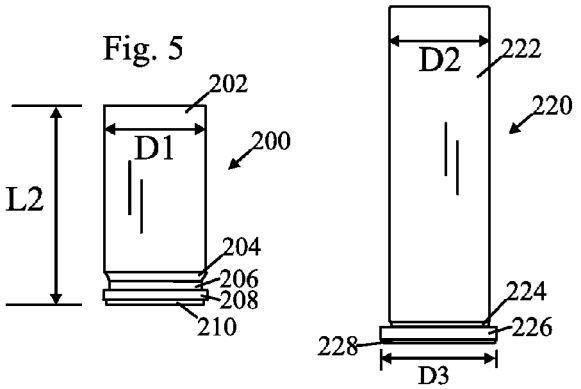
Fig. 7
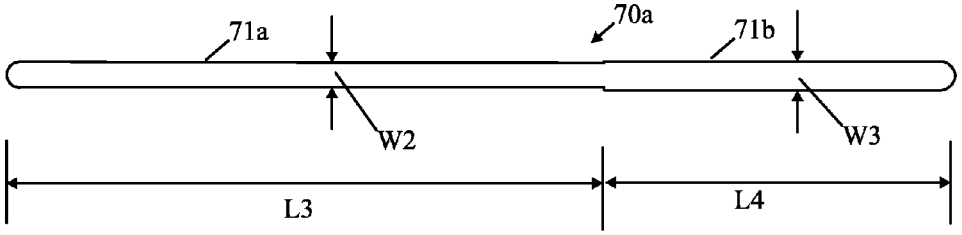

METHOD OF CARTRIDGE CASE SORTING AND SORTING APPARATUS

CROSS REFERENCE TO RELATED APPLICATION(S)

The present patent application claims the priority of U.S. provisional patent application Ser. No. 61/402,312 filed on Aug. 27, 2010, inventor and applicant Jeffrey Scott Green.

FIELD OF THE INVENTION

This invention relates to improved methods and apparatus for sorting.

BACKGROUND OF THE INVENTION

The ammunition reloading industry suffers from a lack of a cost effective high volume method of sorting used firearm cartridge cases for both commercial reloaders and the hobby or recreational reloader. We will simply refer to any person or entity that reuses firearm cartridge cases to create loaded ammunition as a "reloader". Many reloaders obtain mixed lots of used cartridge cases that typically include many different calibers (sizes). The reloader must separate the cases by size. The majority of most lots typically will include 4 or 5 of the most popular sizes along with any number of other sizes. Many of the cases are similar in size and difficult to sort. Most reloaders sort these cases manually. This is a very time consuming and tiring task. The only known device available to the hobby market is a set of trays with holes in each tray that permit only the smaller sizes to pass to the next tray. Possibly faster than manual sorting, using this device is a slow and tedious process. The trays must constantly be emptied after each small quantity is sorted. The holes in any of the trays will possibly fill with larger rimmed cases requiring even more effort to empty that tray. There are also commercial devices available, but their size and cost make them impractical for smaller commercial reloaders and the hobby or recreational reloader.

SUMMARY OF THE INVENTION

One or more embodiments of the present invention provide an automated method of sorting cartridge cases and an apparatus utilizing the method. The apparatus, in at least one embodiment, can be manufactured in a size and price range appropriate to both the commercial and hobby reloader market. The apparatus in at least one embodiment can also be resized as desired to increase speed and capacity. In at least one embodiment, an apparatus is provided for sorting objects, such as firearm cartridge case. The apparatus may include a motor, such as an electrically powered motor. The apparatus may also include a tray assembly having a first plurality of slots, a box assembly, a base assembly having a bottom member, and a first bin lying beneath the first plurality of slots. The tray assembly may be fixed to the box assembly so that the tray assembly is angled with respect to a flat ground surface when the bottom member lies on the flat ground surface. The motor may be connected to the tray assembly so that when the motor is electrically powered on, the motor vibrates the tray assembly. Each of the first plurality of slots may be sized so that a first type of object will fall through each of the first plurality of slots and into the first bin.

Each of the first plurality of slots may include a first section and a second section, such that there are a plurality of first sections and a plurality of second sections, one first section and one second section for each slot of the first plurality of slots, wherein the first section has a first uniform width and the second section has a second uniform width. The first bin may lie beneath each of the first sections of the first plurality of slots, and the first bin may not lie beneath each of the second sections of the first plurality of slots. The apparatus may further include a second bin lying beneath each of the second sections of each of the first plurality of slots.

The apparatus may further include a first plurality of openings following the first plurality of slots along the tray assembly, wherein each opening of the first plurality of openings is sized differently from each of the first plurality of slots.

The apparatus may further include a hopper having first, second, third, and fourth sides which surround a chamber, and wherein the hopper has a bottom member having a first plurality of openings. The hopper may be fixed to the box assembly and the tray assembly near a first end of the tray assembly, and above the tray assembly, so that a plurality of objects can be loaded into the chamber of the hopper and fall through the first plurality of openings and onto the tray assembly, near the first end of the tray assembly. The hopper may includes a second plurality of slots. A trash collection bag may be attached to the hopper underneath the second plurality of slots.

The box assembly may be fixed to the base assembly by one or more springs which allow the motor to vibrate the box assembly and the tray assembly with respect to the base assembly.

In at least one embodiment a method is provided of sorting a plurality of differently sized objects using an apparatus as previously described. The differently sized objects may be firearm cartridge cases.

BRIEF DESCRIPTION OF THE DRAWINGS

FIG. 4 is a top view of an alternate tray assembly which can be used instead of the primary sorter tray assembly with the apparatus of FIG. 1;

FIG. 5 is a side view of a typical known straight wall firearm cartridge case;

FIG. 6 is a side view of a typical known rimmed firearm cartridge case; and

FIG. 7 is a top detail view of a slot of the primary sorter tray assembly of FIG. 3C.

DETAILED DESCRIPTION OF THE DRAWINGS

Figure 1:
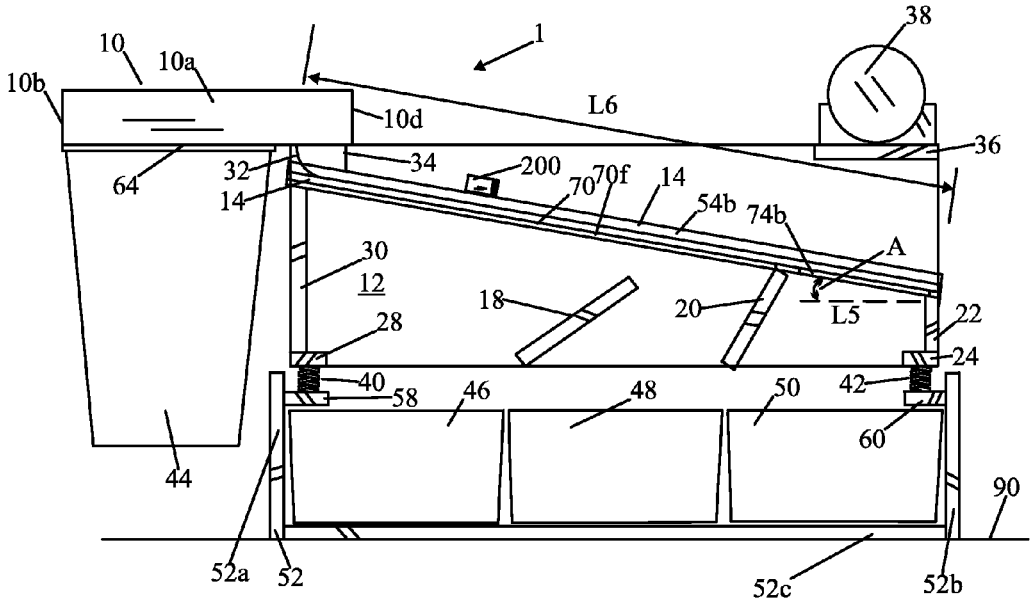
FIG. 1 is a side view of an apparatus in accordance with an embodiment of the present invention.

FIG. 1 is a cross sectional view of an apparatus 1 in accordance with an embodiment of the present invention. The apparatus 1 includes hopper 10, box assembly 12, primary tray assembly 14, diverters 18 and 20, upper spring supports 24 and 28, case guide 32, hopper support bracket 34, motor mounting bracket 36, vibration motor 38, springs 40 and 42, trash collection bag 44, collection bins 46, 48, and 50, base assembly 52, dividers 54*a* and 54*b*, lower spring supports 58 and 60, tray support panels 30 and 22, hopper base 64, plurality of slots 70, a plurality of dividers 72, and holes 74*a* and 74*b* shown in FIG. 3A. The hopper 10 includes sides 10*a*, 10*b*,

10*c*, and 10*d*, and a bottom member 10*e* The sides or side walls 10*a-d* surround a hopper chamber or cavity 10*f* into which a plurality of differently sized firearm cartridge cases can be loaded or dumped. The base assembly 52 includes side wall 52*a*, side wall 52*b*, and bottom member 52*c*. The bottom member 52*c* sits on a flat surface 90 (which may be ground). The apparatus 1 is typically operated with the bottom member 52*c* lying on a flat, zero degree incline ground surface 90. The tray assembly 14 typically would be at an angle A of ten to fifteen degrees with respect to the bottom member 52*c* (which is shown by angle A with respect to dashed line L5, where dashed line L5 is parallel to member 52*c* and ground 90), so that firearm cartridge cases, such as 200, slide down the tray assembly 14, when the vibration motor is powered on and vibrates the box assembly 12 and the tray assembly 14 connected to the box assembly 12.

Figure 2:
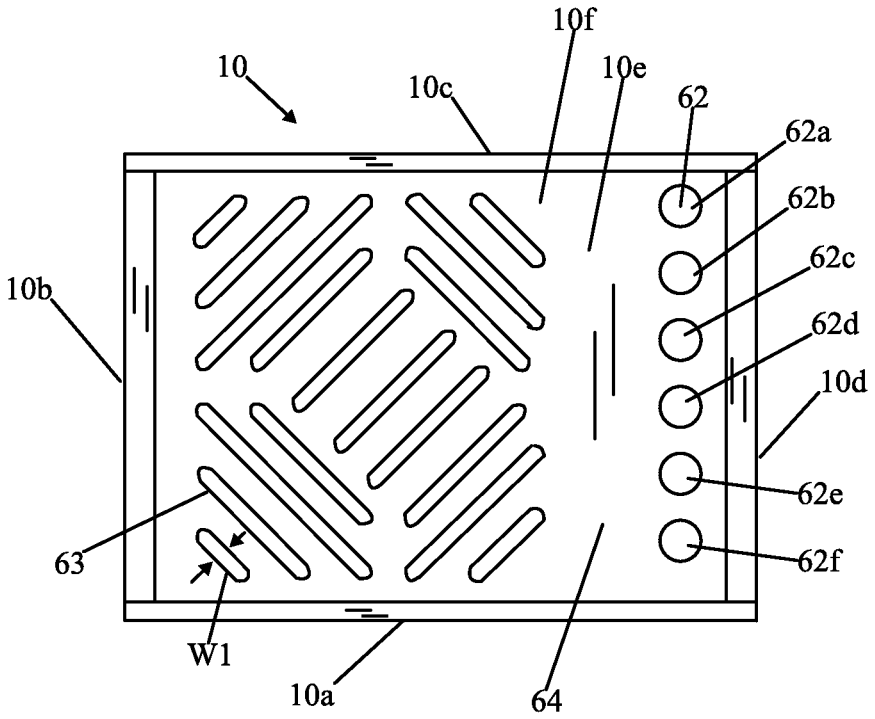
FIG. 2 is a top view of a hopper of the apparatus of FIG. 1.
Figure 3A:
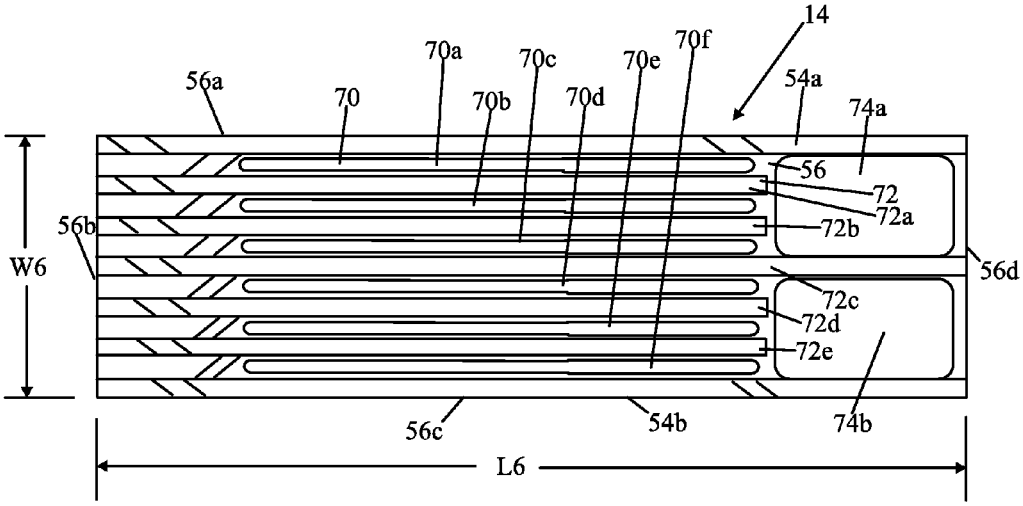
FIG. 3A is a top view of a primary sorter tray assembly of the apparatus of FIG. 1.
Figure 3B:
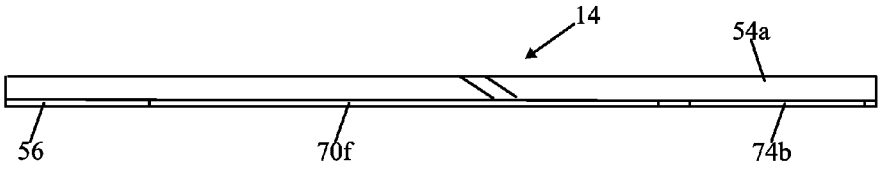
FIG. 3B is a cross sectional view of the primary sorter tray assembly.
Figure 3C:
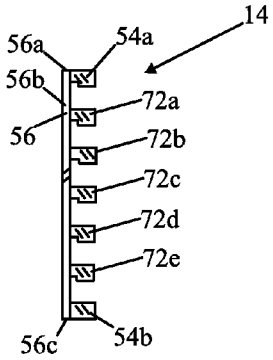
FIG. 3C is a left end view of the primary sorter tray assembly.

FIG. 2 is a top view of the hopper 10. FIG. 3A is a top view of a primary sorter tray assembly 14. FIG. 3B is a side view of the primary sorter tray assembly 14. FIG. 3C is a left end view of the primary sorter tray assembly 14.

As shown in FIG. 3A the primary sorter tray assembly 14 includes the plurality of slots 70 which includes slots 70*a*, 70*b*, 70*c*, 70*d*, 70*e*, and 70*f*. Each of slots 70*a*-70*f* may be identical and may be elongated. The primary sorter tray assembly 14 also includes a body portion 56 in which the slots 70 are formed. The body portion 56 is a flat sheet, which has sides 56*a*, 56*b*, 56*c*, and 56*d*, shown by FIGS. 3A and 3C. The primary sorter tray assembly 14 further includes the plurality of dividers 72, which includes dividers 72*a*, 72*b*, 72*c*, 72*d*, and 72*e*. The assembly 14 further includes openings 74*a* and 74*b*. Dividers 54*a* and 54*b* are fixed to the body portion 56.

One or more embodiments of the present invention are not limited to any particular mixture, but the typical user of this device will desire primarily to sort pistol firearm cartridge cases. Rifle firearm cartridge cases are not as common to be sorted in large quantities. The typical mixed lot of pistol firearm cases will include straight wall cases as shown in FIG. 5 and rimmed cases as shown in FIG. 6. The mixture of firearm cases will vary depending on the source, but will usually contain the most popular firearm cartridges in use. Currently that includes the .22 LR firearm cartridge (.22 Long Rifle rimfire 5.6×15 mm—millimeter R—radius), the 9 mm (millimeter) firearm cartridge, the .38 Special rimmed centerfire cartridge from Smith & Wesson, the .357 Magnum revolver firearm cartridge (9×33 mmR), the .40 S&W (10×22 mm Smith & Wesson) rimless pistol firearm cartridge, and the .45 ACP (11.43×23 mm) automatic Colt pistol firearm cartridge. There will likely be numerous other sizes in smaller quantities within the lot. Note that most dimensions of the .38 Special firearm cases and .357 Magnum firearm cases are the same except for length and both may be referred to in this document as .38 Cal.

One or more embodiments of the present invention described in the present application are for this typical mixture of cases, but can be varied for most other mixtures by changing the dimensions of the components. The most significant change will be to the slots of a primary tray assembly 14 shown in FIG. 3A.

The primary tray assembly 14 is mounted in a box assembly 12 as shown in FIG. 1. Box assembly 12 is suspended over a base 52 that houses collection bins 46, 48 and 50. The suspension is via springs 40, 42 and others not shown. The springs permit the vibration of the box assembly 12. Box assembly 12 contains a hopper 10, collection bag 44 and a vibration motor 38. There are diverters 18 and 20 contained in the box assembly 12 to route firearm cartridge cases placed in the hopper 10 to the proper collection bin 46, 48, and 50. FIG. 1 shows the firearm cartridge 200 on the tray assembly 14. Based upon specific diameter, the firearm cartridge cases 200 and 210 will fall through the appropriate section of the plurality of slots 70 or opening 74*a* or 74*b* and be collected in one of bins 46, 48 or 50.

The apparatus 1 may be constructed of plastic, metal or any other material that may be fabricated with properties and tolerances as required for the part. In a preferred embodiment, typically it is critical that the plurality of slots 70 (FIG. 3A) and 170 (FIG. 4), be precisely cut to allow only the desired sizes of firearm cartridge cases to pass though one of the slots 70 or 170. Other parts must be carefully selected to allow proper vibration of the apparatus.

The vibration motor 38 may be electric, pneumatic or any other power as required and of the proper size for the apparatus 1 being constructed. The motor 38 may be of variable speed to provide more precise control of the flow of cases. Various other methods of vibration may be employed as required for the size device being constructed.

Referring to FIG. 1, operation begins with a quantity of mixed firearm cartridge cases added to the hopper 10. The motor 38 is started causing the box assembly 12 to vibrate. Typically, in at least one embodiment, .22 LR cases are not reused and are considered either trash or scrap. Most dust, small debris and .22 LR cases will fall through one or more of the plurality of slots 63 in hopper base 64 and into the trash collection bag 44. Larger firearm cartridge cases enter plurality of holes 62 and continue onto the tray assembly 14. Tray assembly 14 contains lanes with dividers 54*a*, 54*b*, and 72, shown in FIG. 3A, to control the firearm cartridge cases to pass over or through slots 70. The hopper 10 will be filled as required to keep a continuous flow of firearm cartridge cases, each of which may be, for example, similar to or identical to firearm cartridge case 200 or 210, shown in FIGS. 5 and 6, respectively. Filling the hopper 10 may be done manually by a person or by means of a larger automated hopper, not shown, delivering cases as required to hopper 10.

Each of the openings or slots 63 in hopper base 64 may have a width W1, shown in FIG. 2, which may be 0.30 inches, in at least one embodiment. In at least one embodiment, the width of 0.30 inches is critical and is sized to allow .22 LR firearm cartridge cases and other small firearm cartridge cases to fall through and collect in trash collection bag 44. Larger firearm cartridge cases will continue to plurality of slots 70. The plurality of slots 70 is a critical and unique part of at least one embodiment of the present invention. In at least one embodiment, each of the plurality of slots 70 (including 70*a*-70*f*) have two sections of different widths. These different widths are shown in FIG. 3A and are shown in greater detail as W2 and W3 for slot 70*a* in FIG. 7. Each of slots 70*b*-70*f* may be identical to slot 70*a* and may have the same widths W2 and W3. The position at which the width changes from W2 to W3 will coordinate with the position of diverter 18. Typically, the greatest diameter of 9 MM (millimeter) firearm cartridge cases is 0.392 inches. A first section of each of the plurality of slots 70, such as first section 71*a* having a width of W2, which may be 0.40 inches allows 9 MM (millimeter) firearm cartridge cases to fall through first section 71*a* and into the bin 46. Larger diameter firearm cartridge cases will pass over section 71*a*. Furthermore, .38 Cal. (caliber) firearm cartridge cases have a neck diameter of 0.379 inches that is close to the overall diameter of 9 MM cases and a rim diameter of 0.44 inches that is close to the overall diameter of .40 S&W Cal (caliber) firearm cartridge cases which is 0.424 inches. Each of the first sections of each of the plurality of slots 70, such as section 71*a* of slot 70*a* have a width W2 (such as 0.40 inches) which allows .38 Cal firearm cartridge cases to fall partly through and remain supported by the wider rim of a .38 firearm cartridge case. Each of the plurality of slots 70 has a second wider section, such as 71*b* for slot 70*a*, that is W3 inches in width, which may be 0.45 inches. In at least one embodiment, the W2 width of about 0.40 inches (within a range of +/−0.005 inches, wherein the range is critical in at least one embodiment so that the firearm cartridge cases will fall through the appropriate openings or slots) and the W3 width of 0.45 inches is critical. The vibration movement of box assembly 12 caused by motor 38, which also vibrates tray assembly 14, diverters 18 and 20, which are fixed to the box assembly 12, will allow the .38 Cal firearm cartridge cases to continue to the wider portion of each of the plurality of slots 70, such as section or portion 71*b* of slot 70*a*, which begins directly above diverter 18 and fall through to bin 48. The .40 S&W Cal cases will also continue past the smaller width sections of the plurality of slots 70, such as section or portion 71*a* and fall through to bin 48. Firearm cartridge cases larger than .40 S&W Cal will continue past the plurality of slots 70 and fall through hole 74*a* or 74*b* and be collected in bin 50.

Firearm cartridge cases of similar diameter to the described firearm cartridge cases will be collected in the same bin. These other cases will later be removed manually during a final quality control check. Alternatively, additional trays similar to or identical to tray 14 can be created and sized to sort specific mixtures. Larger devices with longer trays similar to or identical to tray 14 can have additional slots preceding or succeeding the plurality of slots 70 of other sizes to further sort and reduce these mixtures. A longer tray for tray 14 may be required to allow dwell time for the cases to fall through the appropriate slot.

One embodiment of an alternative tray would be to further sort the contents of bin 48. After using the primary tray assembly 14, bin 48 will contain primarily a mixture of .40 Cal, .38 Cal and .357 Magnum firearm cartridges or cases. The primary tray assembly 14 may be removable and can be replaced with the alternate tray assembly 114 in FIG. 4. FIG. 4 is a top view of the alternate tray assembly 114 which can be used, instead of the primary sorter tray assembly 14, with the apparatus 1 of FIG. 1. The tray assembly 114 includes plurality of slots 170, including slots 170*a*, 170*b*, 170*c*, 170*d*, 170*e*, and 170*f*, plurality of case diverters 176*a*, 176*b*, 176*c*, 176*d*, 176*e*, and 176*f*, and a plurality of dividers 172 including dividers 172*a*, 172*b*, 172*c*, 172*d*, and 172*e*. The tray assembly 114 also includes dividers 154*a* and 154*b*, body portion 156, and holes 174*a* and 174*b*. The tray assembly 114 differs from the tray assembly 14 with the configuration of slots 170 and the inclusion of a of plurality of diverters 176 (includes diverters 176*a*-176*f*) positioned at the end of each of slots 170. Each of the plurality of slots 170 may have a width of W4, which may be 0.40 inches in width allowing the neck of .38 Cal. firearms cartridge cases to partially fall through. In at least one embodiment a width W4 of 0.40 inches may be critical. The end of each of slots 170, such as end 171*a* of the slot 170*a*, is widened to W5, which may be 0.50 inches, for a length L1, which may be 0.75 inches. The dimensions, in at least one embodiment are critical for sorting specific firearm cartridge cases. Slots 170 will extend to a point preceding diverter 20 to prevent .38 Cal cases from falling into the bin 50. The contents of bin 48, in at least one embodiment are now sorted with this additional tray 114. I.e., the tray 14 is taken out of the apparatus 1, and replaced by tray 114, and then the apparatus 1 is run again to sort what previously fell into bin 48.

When the alternate tray assembly 114 is used in place of primary tray assembly 14 in the apparatus 1, the plurality of slots 170 of the alternate tray assembly 114 allow .38 Cal firearm cartridges or cases to travel to the end of the plurality of slots 170 and fall through into bin 48. Diverters 176 will prevent the .40 Cal firearm cartridges or cases from entering plurality of slots 170 and allow the .40 Cal firearm cartridges to continue into hole 174*a* or 174*b* and bin 50.

Unlimited variations of the tray assembly 14 can be designed for any case combination.

FIG. 7 is a top detail view of slot 70*a*.

The slot dimensions, W2 and W3 shown in FIG. 7 of slot 70*a* (and of identical slots 70*b*-70*f*) are critical dimensions, but these dimensions will vary based upon the particular mixture of firearm cartridge cases that the tray assembly, such as tray assembly 14, is configured to sort. The slot portion or section 71*a* shown in FIG. 7 may have a length L3 which may be 9.3 inches. The slot portion or section 71*b* shown in FIG. 7 may have a length L4 which may be 5.3 inches. The two section slot, such as slot 70*a* in FIG. 7, having two widths W2 and W3 is a critical part of one or more embodiments of the invention, that allows the apparatus 1 to function and function well. In contrast, if the apparatus 1 had just a bunch of holes of the same size each hole would jam with the rimmed .38s in the 9 MM slot, so this allows a continuous flow that is not otherwise possible.

In at least one embodiment, the configuration and/or sizing of the plurality of slots 70 is critical to making the apparatus 1 work well in continuously sorting firearm cartridge cases.

For example, a typical firearm cartridge case mixture today would probably include three of the most popular firearm cartridge cases: 9 MM, .38 special and .40 Caliber S&W.

In accordance with at least one embodiment of the present invention, the diameter of a cartridge case is significant in the sorting process. FIG. 5 is a side view of a typical known straight wall firearm cartridge case 200. The firearm cartridge case 200 includes portions 202, 204, 206, 208, and 210. The portions 202, 206, 208, and 210 are cylinders. The portion 204 has a gradually decreasing diameter from an end connecting to portion 202 to an end connecting to portion 206. The apparatus 1 typically performs sorting based upon the diameters of the firearm cartridge cases. In at least one embodiment, the length of any firearm cartridge case has little if any impact on the operation.

The greatest diameter of the firearm cartridge case 200 is D1 which is the diameter of the portion 202 and the portion 208. The firearm cartridge case 200 is known as a straight wall cartridge case because the portion 208 is the same diameter as the portion 202. Firearm 9 MM cartridge cases and .40 Caliber cartridge cases are straight wall cartridge cases and may be similar to or identical to firearm cartridge case 200 in FIG. 5. For 9 MM firearm cartridge cases, the diameter D1 (of FIG. 5) would typically be 0.392 inches. For .40 caliber firearm cartridge cases the diameter D1 (of FIG. 5) would typically be 0.424 inches.

FIG. 6 is a side view of a typical known rimmed firearm cartridge case 220. The firearm cartridge case 220 includes portions 222, 224, 226, and 228. The portions 222, 224, 226, and 228 are cylinders. The portion 222 has a diameter of D2, while the rim 226 has a diameter of D3 which is larger than D2. Firearm .38 special cartridge cases are rimmed firearm cartridge cases and may be similar to or identical to firearm cartridge case 220. For .38 special firearm cartridge case, D2 is typically 0.379 inches and D3 is 0.44 inches.

In a known sorting technique referred to on the web site www.shellshorter.com (trademarked), a plurality of different trays are provided, one tray for each diameter of shell or firearm cartridge case. The known www.shellsorter.com (trademarked) sorting technique does not refer to a machine but rather generally sorting manually with the plurality of trays. For example, the shellsorter.com technique might include first, second, and third trays. The first tray, would have slots of a first uniform width, the second tray slots of a second uniform width, and the third tray would have slots of a third uniform width, with the first, second, and third uniform widths being different from one another. The first uniform width of slots of the first tray, for example, might be 0.40 inches to allow 9 MM firearm cartridge cases (straight wall configuration—0.392 inches outer diameter D1 of FIG. 5) to fall through the slots of the first tray to separate the 9 MM firearm cartridge cases from larger diameter firearm cartridge cases. The second uniform width of slots of the second tray, for example, might be 0.45 inches to allow .40 caliber firearm cartridges cases (straight wall configuration—0.424 inches outer diameter D1—FIG. 5), and .38 special firearm cartridge cases (rimmed configuration—D2: 0.379 inches, and D3: 0.44 inches) to fall through the second tray and be separated from larger diameter cartridge cases. The third tray might have slots of a third uniform width greater than 0.45 inches to allow larger firearm cartridges to fall through to allow other firearm cartridge cases to be sorted from a group of different types of firearm cartridge cases.

The known www.shellshorter.com (trademarked) technique does not provide a powered machine in contrast to embodiments of the present invention. The known www-.shellsorter.com (trademarked) technique merely provides a plurality of trays or bowls which can be used to sort firearm cartridge cases or shells of differing sizes.

In contrast, one or more embodiments of the present invention provide a machine, or apparatus 1, which is typically electrically powered having electrically powered motor 38, which shakes or causes vibration of box assembly 12 which is connected to and thereby causes vibration of tray assembly 14 to cause firearm cartridge cases to slide down tray assembly 14 and into one of appropriate bins 46, 48 or 50, through plurality of slots 70 or openings 74*a*-74*b*.

In addition, in at least one embodiment of the present invention, the problem of rimmed firearm cartridge cases like case 220 in FIG. 6 is dealt with. The .38 special firearm cartridge cases, because they are configured like case 220 in FIG. 6, can be a problem if slots of uniform width are used in the apparatus 1, instead of stepped slot 70*a* shown in FIG. 7, in accordance with an embodiment of the present invention. For example, if a machine in accordance with an embodiment of the present invention, were constructed with two sets of slots (in place of stepped slots 70) each of uniform width in series on the tray assembly 14, with each of the first set of slots having a first width of 0.40 inches and each of the the second set of slots having a second width of 0.45 inches, the smaller diameter of the top section of the .38 special firearm cartridge case (D2 in FIG. 6) will fall into the 0.40 inch slot of the first set of slots but the 0.44 rim (diameter D3 in FIG. 6) of the .38 special firearm cartridge case would prevent complete passing through the first set of slots and would cause the .38 special firearm cartridge case to remain suspended by the rim in the hole of first set of separate slots thus clogging the first set of separate slots in this possible embodiment of the present invention.

In a preferred embodiment of the present invention, to solve the .38 special firearm cartridge case, instead of two sets of slots of different uniform widths, each slot of the plurality of slots 70 has a stepped configuration, as for slot 70*a* shown in FIG. 7. The width W2 of the first section 71*a*, in this example, is 0.40 inches, and the width W3 of the second section 71*b* is 0.45 inches slot. Using these dimensions for slot 70*a*, a .38 special case falls partly through the narrow section 71*a* (i.e. section 222 of FIG. 6 falls partly through 71*a*), the .38 special case is suspended by the rim (226 of FIG. 6) of the .38 special firearm cartridge case and will continue moving or sliding along the tray assembly 14, while the assembly 14 is being shaken by electrically powered motor 38, to the larger 0.45 inch section 71*b* where the .38 special case completely falls through the slot 70*a* and into the bin 48. In at least one embodiment, bin 48 will contain both .38 special and .40 caliber firearm cartridge cases. This may be acceptable in one or more embodiments and may be further sorted with an alternative tray, such as tray 114 of FIG. 4.

However, although the stepped slot 70*a* is preferred for each of slots 70 (identical to slot 70*a* shown in FIG. 7) other embodiments of the present invention may include two or more sets of separate slots along the length of the tray assembly 14, wherein each set of slots has a uniform width as opposed to a stepped width.

The overall dimensions of the apparatus 1, in accordance with one or more embodiments of the present invention, is determined primarily by the dimensions of the tray assembly 14. In at least one embodiment of the present invention, the dimensions of tray assembly 14 are about 7.5 inches in width, W6, shown in FIG. 3A, and about twenty-four inches in length, L6, shown in FIG. 3A and in FIG. 1. The dimensions for the length L6 of the tray assembly 14, in at least one embodiment, may be critical to allow the firearm cartridges case enough length along the tray assembly 14 to properly be sorted. In at least one embodiment, all other parts may be sized accordingly to accommodate the tray assembly 14.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus for sorting objects comprising:

a motor;

a tray assembly having a first plurality of slots;

a box assembly;

a base assembly having a bottom member;

a first bin lying beneath the first plurality of slots; and a second bin lying beneath the first plurality of slots;

wherein the tray assembly is fixed to the box assembly so that the tray assembly is angled with respect to a flat ground surface when the bottom member lies on the flat ground surface;

wherein the motor is connected to the tray assembly so that when the motor is electrically powered on, the motor vibrates the tray assembly;

wherein each of the first plurality of slots includes a first section and a second section, such that there are a plurality of first sections and a plurality of second sections, one first section and one second section for each slot of the first plurality of slots, wherein the first section has a first uniform width and the second section has a second uniform width;

wherein the first bin is positioned so that objects falling through each of the plurality of first sections, fall into the first bin; but not the second bin; and wherein the second bin is positioned so that objects falling through each of the plurality of second sections, fall into the second bin, but not the first bin; and further comprising a hopper having first, second, third, and fourth sides which surround a chamber, and wherein the hopper has a bottom member having a first plurality of openings;

wherein the hopper is fixed to the box assembly and the tray assembly near a first end of the tray assembly, and above the tray assembly, so that a plurality of objects can be loaded into the chamber of the hopper and fall through the first plurality of openings and onto the tray assembly, near the first end of the tray assembly;

wherein the hopper includes a second plurality of slots;

and further comprising a trash collection bag attached to the hopper underneath the second plurality of slots.

2. The apparatus of claim 1 wherein each first section of the plurality of first sections has one corresponding adjacent second section of the plurality of second sections for each slot of the plurality of slots;

wherein each first section of the plurality of first sections is an opening defined by first, second, third, and fourth sides;

wherein the first and third sides of each first section are substantially parallel to each other and are closed;

wherein the fourth side of each first section is substantially perpendicular to the first and the third sides of each first section and is closed;

wherein the second side of each first section is substantially parallel to the fourth side of each first section and is open;

wherein each adjacent second section of the plurality of adjacent second sections is an opening defined by first, second, third, and fourth sides;

wherein the first and third sides of each adjacent second section are substantially parallel to each other and are closed;

wherein the second side of each adjacent second section is substantially perpendicular to the first and the third sides of each adjacent second section and is closed;

wherein the fourth side of each adjacent second section is substantially parallel to the second side of each adjacent second section and is open;

wherein the second side of each first section is the same as the fourth side of its corresponding adjacent second section;

wherein each first section and its corresponding adjacent second section do not overlap;

wherein each first section has a first dimension so that a first type of object will fall into each first section but not through each first section; and wherein each second section has a second dimension which is greater than the first dimension so that the first type of object will fall through each second section.

3. The apparatus of claim 1 further comprising a first plurality of openings following the first plurality of slots along the tray assembly;

wherein each opening of the first plurality of openings is sized differently from each of the first plurality of slots.

4. The apparatus of claim 2 further comprising a first plurality of openings following the first plurality of slots along the tray assembly;

wherein each opening of the first plurality of openings is sized differently from each of the first plurality of slots.

5. The apparatus of claim 1 wherein the box assembly is fixed to the base assembly by one or more springs which allow the motor to vibrate the box assembly and the tray assembly with respect to the base assembly.

6. A method comprising sorting a plurality of differently sized objects using an apparatus, the apparatus comprising a motor;

a tray assembly having a first plurality of slots;

a box assembly; and a base assembly having a bottom member;

a first bin lying beneath the first plurality of slots; and a second bin lying beneath the first plurality of slots;

wherein the tray assembly is fixed to the box assembly so that the tray assembly is angled with respect to a flat ground surface when the bottom member lies on the flat ground surface;

wherein the motor is connected to the tray assembly so that when the motor is electrically powered on, the motor vibrates the tray assembly;

wherein each of the first plurality of slots is sized so that a first type of object will fall through each of the first plurality of slots;

wherein each of the first plurality of slots includes a first section and a second section, such that there are a plurality of first sections and a plurality of second sections, one first section and one second section for each slot of the first plurality of slots, wherein the first section has a first uniform width and the second section has a second uniform width;

wherein the first bin is positioned so that objects falling through each of the plurality of first sections, fall into the first bin; but not the second bin;

wherein the second bin is positioned so that objects falling through each of the plurality of second sections, fall into the second bin, but not the first bin;

wherein the apparatus further includes a hopper having first, second, third, and fourth sides which surround a chamber, and wherein the hopper has a bottom member having a first plurality of openings; and wherein the hopper is fixed to the box assembly and the tray assembly near a first end of the tray assembly, and above the tray assembly, so that a plurality of objects can be loaded into the chamber of the hopper and fall through the first plurality of openings and onto the tray assembly, near the first end of the tray assembly;

wherein the hopper includes a second plurality of slots;

and wherein the apparatus further includes a trash collection bag attached to the hopper underneath the second plurality of slots.

7. The method of claim 6 wherein wherein each of the plurality of first sections has one corresponding adjacent second section of the plurality of second sections for each slot of the plurality of slots;

wherein each first section of the plurality of first sections is an opening defined by first, second, third, and fourth sides;

wherein the first and third sides of each first section are substantially parallel to each other and are closed;

wherein the fourth side of each first section is substantially perpendicular to the first and the third sides of each first section and is closed;

wherein the second side of each first section is substantially parallel to the fourth side of each first section and is open;

wherein each adjacent second section of the plurality of adjacent second sections is an opening defined by first, second, third, and fourth sides;

wherein the first and third sides of each adjacent second section are substantially parallel to each other and are closed;

wherein the second side of each adjacent second section is substantially perpendicular to the first and the third sides of each adjacent second section and is closed;

wherein the fourth side of each adjacent second section is substantially parallel to the second side of each adjacent second section and is open;

wherein the second side of each first section is the same as the fourth side of its corresponding adjacent second section;

wherein each first section and its corresponding adjacent second section do not overlap;

wherein each first section has a first dimension so that a first type of object will fall into each first section but not through each first section; and wherein each second section has a second dimension which is greater than the first dimension so that the first type of object will fall through each second section.

8. The method of claim 6 wherein the apparatus includes a first plurality of openings following the first plurality of slots along the tray assembly; and wherein each opening of the first plurality of openings is sized differently from each of the first plurality of slots.

9. The method of claim 7 wherein the apparatus includes a first plurality of openings following the first plurality of slots along the tray assembly; and wherein each opening of the first plurality of openings is sized differently from each of the first plurality of slots.

10. The method of claim 6 wherein the differently sized objects are firearm cartridge cases.

11. The method of claim 6 wherein the box assembly is fixed to the base assembly by one or more springs which allow the motor to vibrate the box assembly and the tray assembly with respect to the base assembly.

* * * * *